US010219605B1

(12) United States Patent
Love

(10) Patent No.: US 10,219,605 B1
(45) Date of Patent: Mar. 5, 2019

(54) WIG TREE

(71) Applicant: Belva Love, Fayetteville, NC (US)

(72) Inventor: Belva Love, Fayetteville, NC (US)

( * ) Notice: Subject to any disclaimer, the term of this patent is extended or adjusted under 35 U.S.C. 154(b) by 0 days.

(21) Appl. No.: 15/865,521

(22) Filed: Jan. 9, 2018

(51) Int. Cl.

| | |
|---|---|
| ***A47F 5/04*** | (2006.01) |
| ***A47F 5/06*** | (2006.01) |
| ***A47F 7/06*** | (2006.01) |
| ***A45D 44/14*** | (2006.01) |
| ***A47B 45/00*** | (2006.01) |
| ***A47B 61/04*** | (2006.01) |
| ***A47B 96/14*** | (2006.01) |
| ***A47G 25/06*** | (2006.01) |
| ***A47G 25/10*** | (2006.01) |
| ***D06F 57/04*** | (2006.01) |

(52) U.S. Cl.
CPC ..... *A45D 44/14* (2013.01); *A47B 45/00* (2013.01); *A47B 61/04* (2013.01); *A47B 96/1408* (2013.01); *A47B 96/1483* (2013.01); *A47F 5/04* (2013.01); *A47F 5/06* (2013.01); *A47F 7/065* (2013.01); *A47G 25/0664* (2013.01); *A47G 25/10* (2013.01); *D06F 57/04* (2013.01)

(58) Field of Classification Search
CPC ... A45D 44/14; A42C 3/04; A47F 7/06; A47F 5/04; A47F 7/065; A47F 5/06; A47F 5/10; A47B 45/00; A47B 61/04; A47B 96/14; A47B 96/1408; A47B 96/1433; A47B 96/145; A47B 96/1458; A47B 96/1483; A47G 25/00; A47G 25/10; A47G 25/0664; A47G 25/0685; D06F 57/04; D06F 57/08
USPC ..... 211/33, 197, 196, 172, 205, 85.24, 175, 211/30, 37, 171, 59.1
See application file for complete search history.

(56) References Cited

U.S. PATENT DOCUMENTS

| | | | | | |
|---|---|---|---|---|---|
| 1,051,052 | A * | 1/1913 | Aitcheson | A47F 7/06 | 211/33 |
| 1,266,749 | A * | 5/1918 | Abbott | A47F 5/04 | 211/196 |
| 1,276,300 | A * | 8/1918 | Wideen | A47F 5/06 | 211/172 |
| 1,729,395 | A * | 9/1929 | Mandel | A47G 25/0664 | 211/172 |
| 1,748,597 | A * | 2/1930 | Collins | A47G 25/0664 | 211/172 |
| 1,973,521 | A * | 9/1934 | Bullard | A47G 25/0664 | 211/172 |
| 3,018,898 | A * | 1/1962 | Frazelle | A47B 96/1425 | 211/107 |
| 3,168,200 | A * | 2/1965 | Larson | A47F 5/06 | 211/182 |
| 3,252,678 | A * | 5/1966 | Lasch | A47F 5/06 | 211/123 |
| 3,281,102 | A * | 10/1966 | Hobson | A47B 57/42 | 108/108 |

(Continued)

*Primary Examiner* — Jennifer E. Novosad

(57) ABSTRACT

The wig tree is configured for use with a hairpiece. The wig tree is configured to sit on a tabletop or other supporting surface. The wig tree is a stand upon which one or more hairpieces are stored. The wig tree is adjustable such that the number of hairpieces stored on the wig tree is adjustable. The wig tree comprises a telescopic stanchion, a pedestal, and a plurality of hangers. The telescopic stanchion attaches the pedestal to the plurality of hangers. Each of the plurality of hangers removably attaches to the telescopic stanchion. The span of the telescopic stanchion is adjustable.

5 Claims, 5 Drawing Sheets

(56) References Cited

U.S. PATENT DOCUMENTS 3,502,293 A * 3/1970 Bard ..... A47F 5/06 248/243
3,524,616 A * 8/1970 Marschak ..... A47B 57/425 211/205
3,602,372 A 8/1971 Verrecchio
3,771,665 A * 11/1973 Potter ..... A47F 5/06 211/107
3,779,433 A * 12/1973 Imai ..... A45D 44/14 223/66
D230,777 S * 3/1974 Imai ..... D28/93
3,820,694 A 6/1974 Pabis
3,847,285 A 11/1974 Leprince
6,112,909 A * 9/2000 Moseley ..... A47F 5/0807 211/30
6,595,377 B1 * 7/2003 Hetu ..... A47F 7/0078 211/196
6,702,129 B1 * 3/2004 Harris ..... A47G 25/0664 211/172
7,165,689 B2 * 1/2007 McDaniel ..... A47B 96/061 211/116
D538,064 S * 3/2007 Schechter ..... D6/674.1
D624,332 S * 9/2010 Nwatu ..... D20/32
D719,769 S * 12/2014 Daniels ..... D6/682.1
8,950,591 B1 * 2/2015 McDowell ..... A45D 44/14 211/13.1
8,998,002 B1 * 4/2015 Milner ..... A47F 7/065 211/13.1
9,538,831 B1 * 1/2017 Tracy ..... A45D 44/14
9,833,892 B1 * 12/2017 Gomez ..... B25H 1/12
2008/0169253 A1 * 7/2008 Vitale ..... A47B 57/06 211/85.7
2014/0263882 A1 * 9/2014 Kull ..... A47F 5/06 248/125.3
2016/0262560 A1 * 9/2016 Fields ..... A47G 25/10
2016/0374483 A1 12/2016 Maldonado
2017/0238726 A1 * 8/2017 Bacon ..... A47F 5/06

* cited by examiner

WIG TREE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including hairdressing equipment, more specifically, a stand for performing hairdressing work.

SUMMARY OF INVENTION

The wig tree is configured for use with a hairpiece. The wig tree is configured to sit on a tabletop or other supporting surface. The wig tree is a stand upon which one or more hairpieces are stored. The wig tree is adjustable such that the number of hairpieces stored on the wig tree is adjustable. The wig tree comprises a telescopic stanchion, a pedestal, and a plurality of hangers. The telescopic stanchion attaches the pedestal to the plurality of hangers. Each of the plurality of hangers removably attaches to the telescopic stanchion. The span of the telescopic stanchion is adjustable.

These together with additional objects, features and advantages of the wig tree will be readily apparent to those of ordinary skill in the art upon reading the following detailed description of the presently preferred, but nonetheless illustrative, embodiments when taken in conjunction with the accompanying drawings.

In this respect, before explaining the current embodiments of the wig tree in detail, it is to be understood that the wig tree is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the wig tree.

It is therefore important that the claims be regarded as including such equivalent construction insofar as they do not depart from the spirit and scope of the wig tree. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
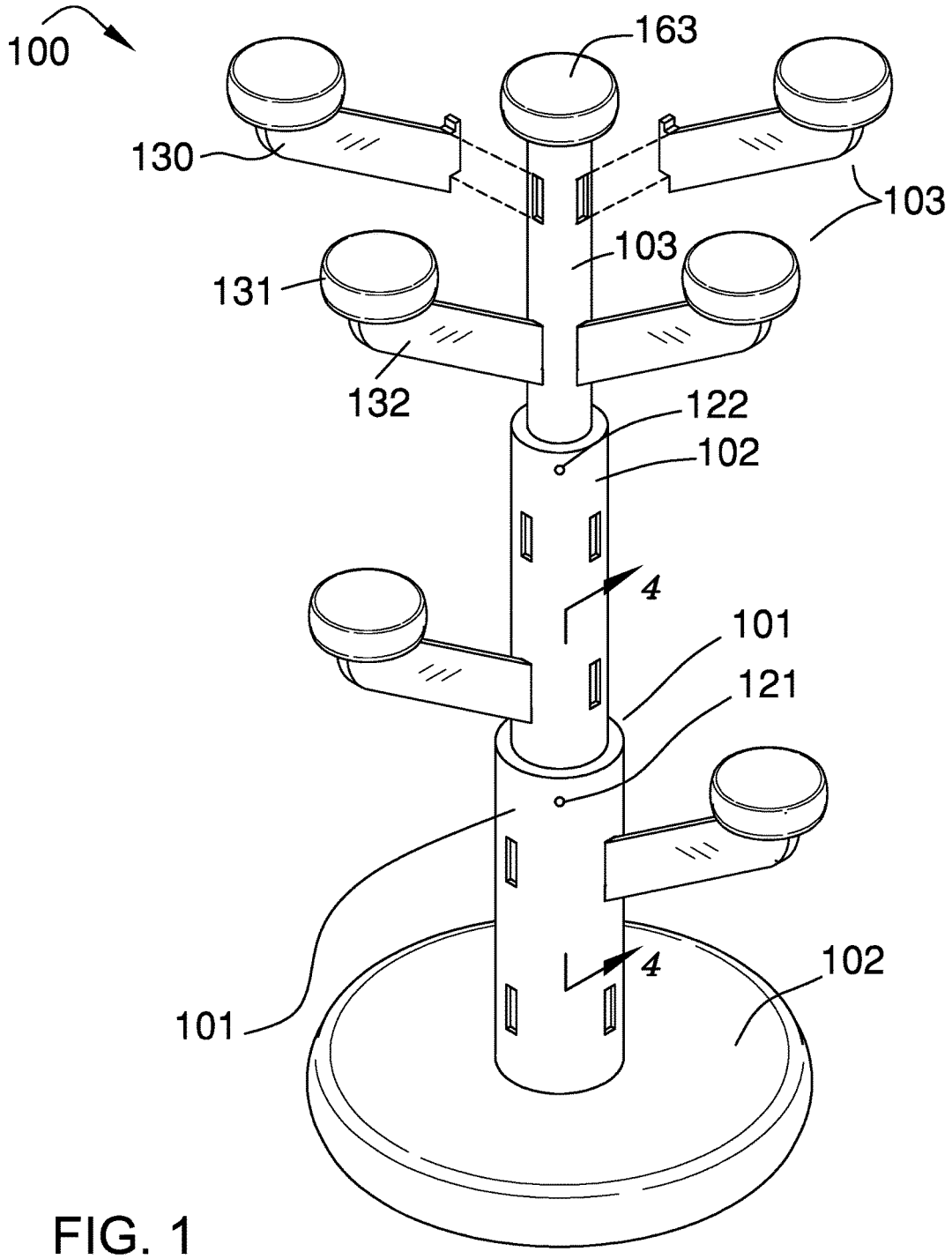
FIG. 1 is an exploded in-use view of an embodiment of the disclosure.
Figure 2:
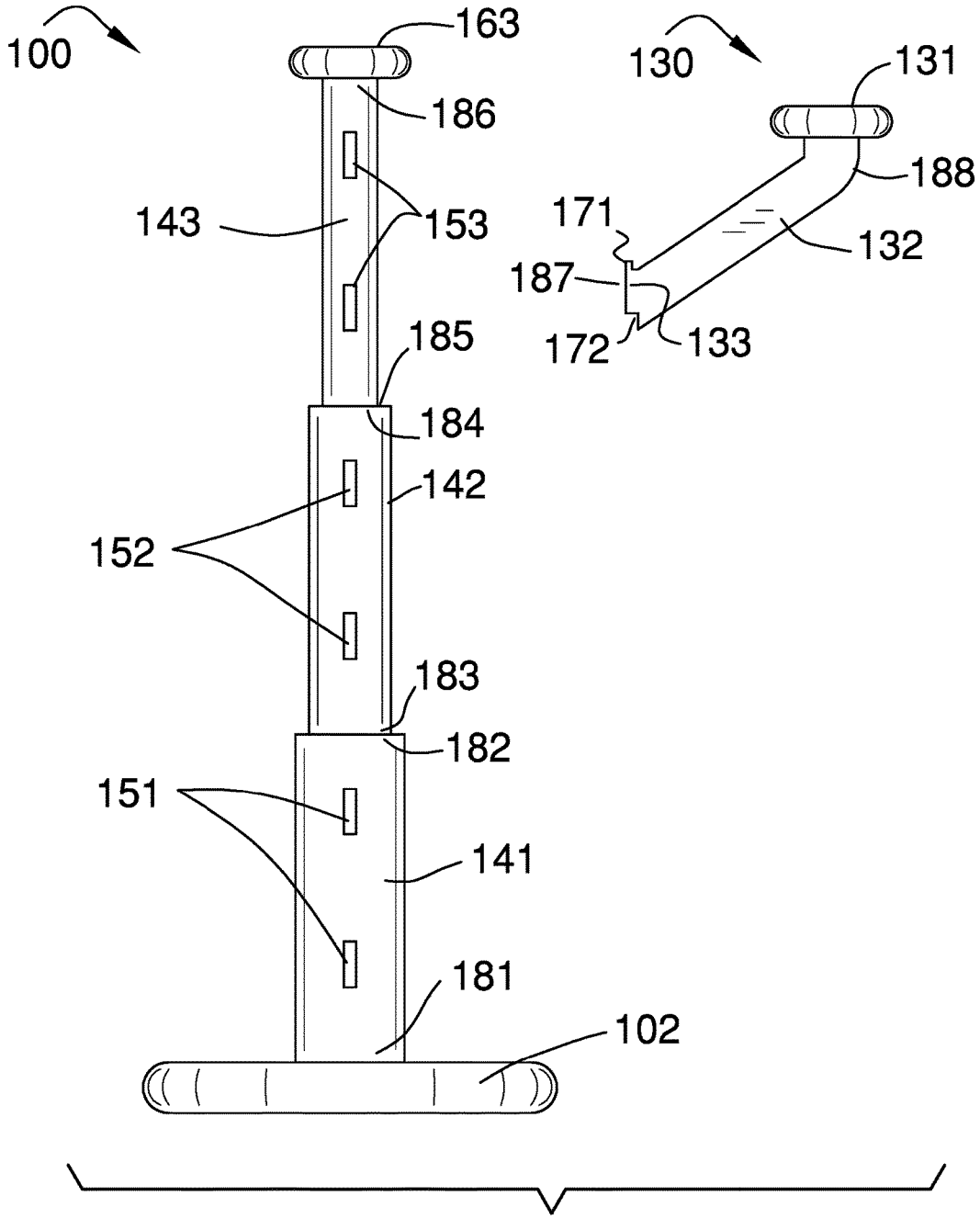
FIG. 2 is a front view of an embodiment of the disclosure.
Figure 3:
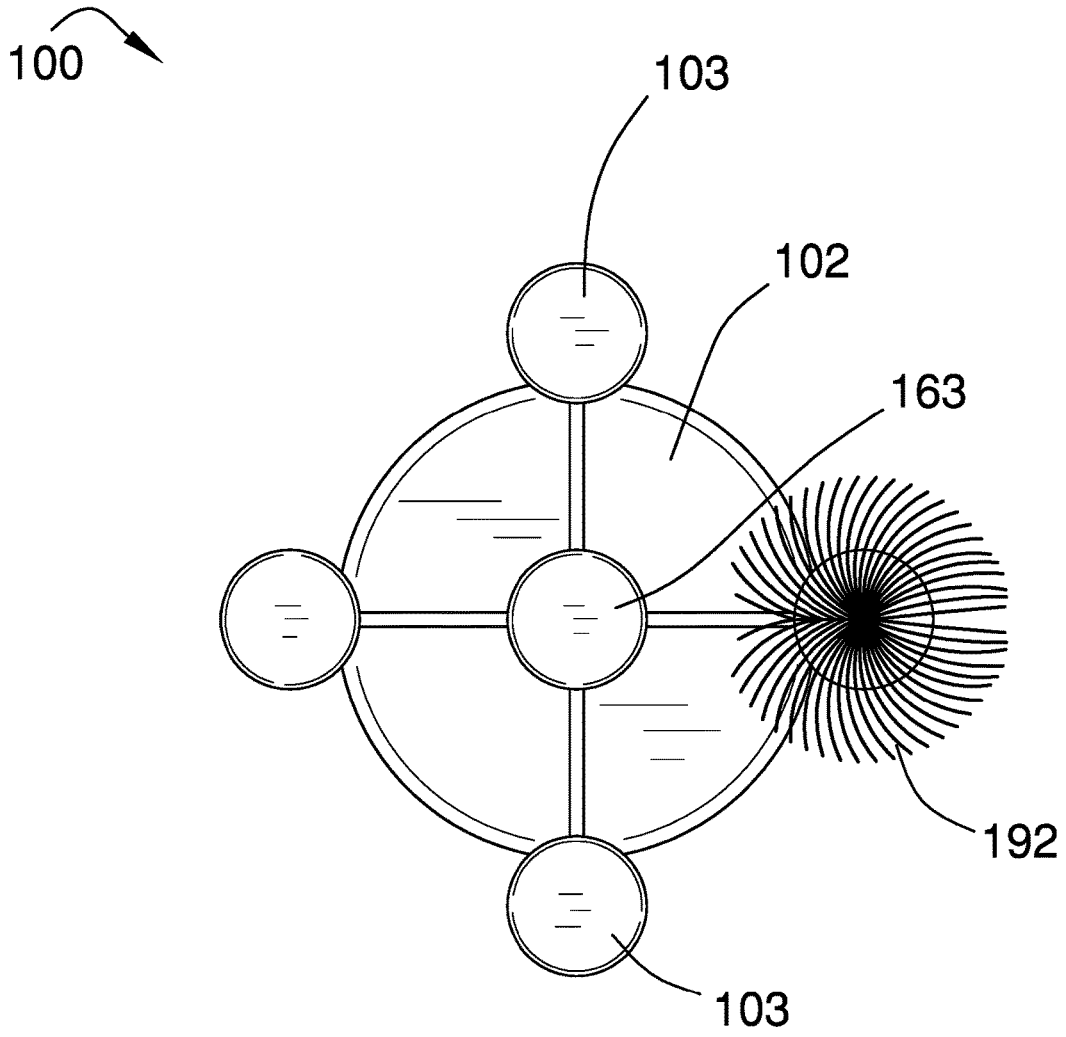
FIG. 3 is a top view of an embodiment of the disclosure.
Figure 4:
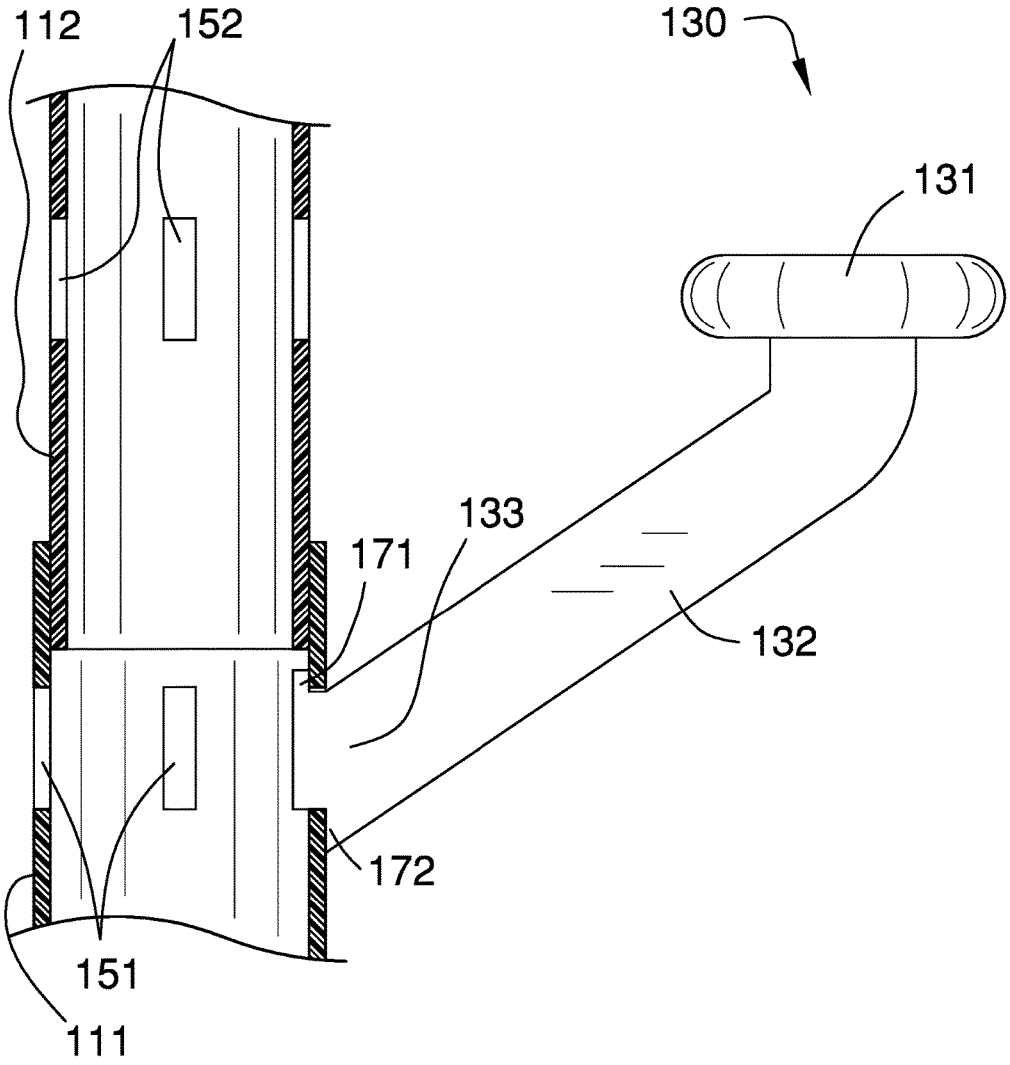
FIG. 4 is a cross-sectional view of an embodiment of the disclosure across 4-4 as shown in FIG. 1.
Figure 5:
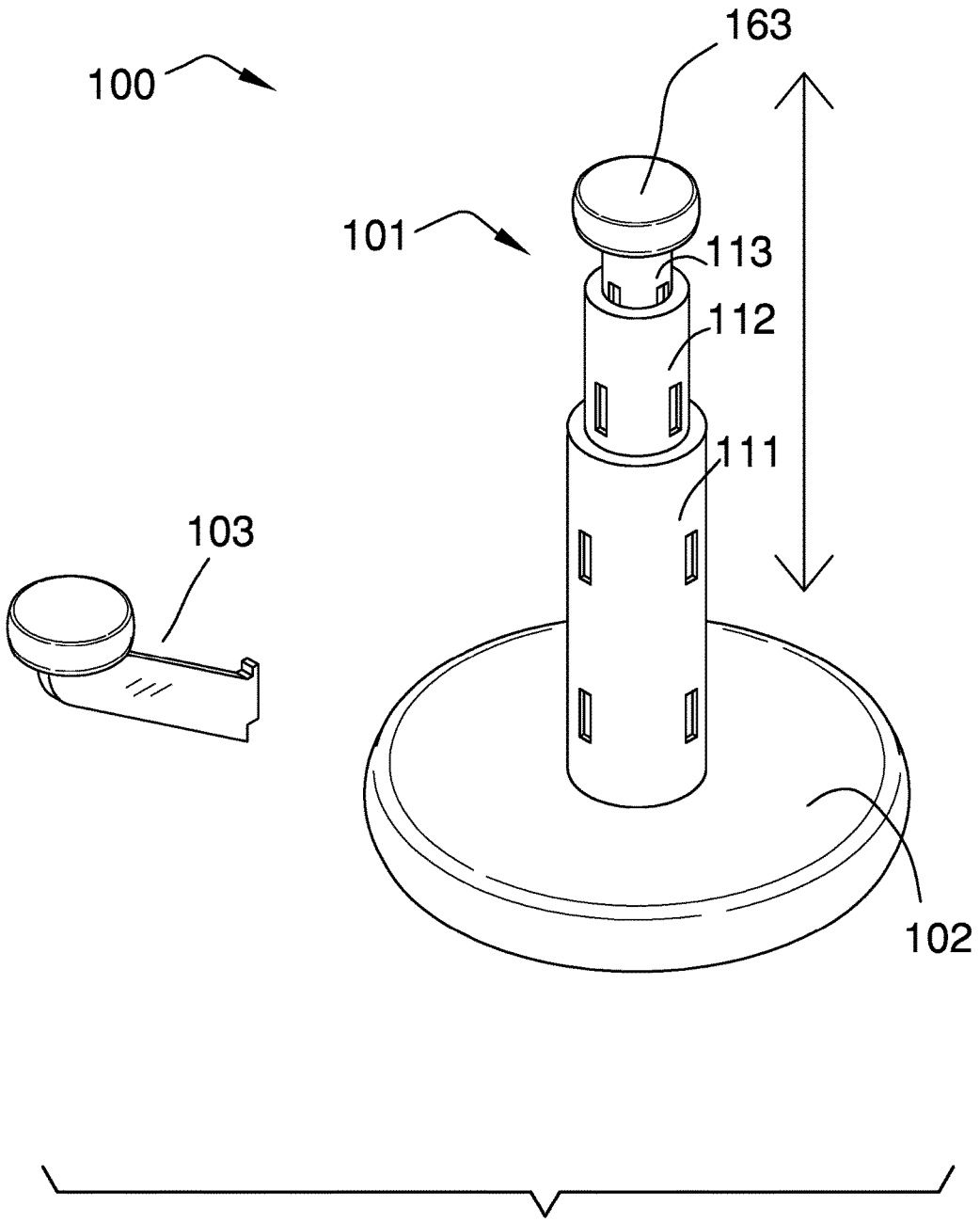
FIG. 5 is a collapsed perspective view of an embodiment of the disclosure.

Detailed reference will now be made to one or more potential embodiments of the disclosure, which are illustrated in FIGS. 1 through 5.

The wig tree 100 (hereinafter invention) is a configured for use with a hairpiece selected from one or more hairpieces 191. The invention 100 is configured to sit on a tabletop or other supporting surface 192. The invention 100 is a stand upon which one or more hairpieces 191 are stored. The invention 100 is adjustable such that the number of hairpieces 191 stored on the invention 100 is adjustable. The invention 100 comprises a telescopic stanchion 101, a pedestal 102, and a plurality of hangers 103. The telescopic stanchion 101 attaches the pedestal 102 to the plurality of hangers 103. Each of the plurality of hangers 103 removably attaches to the telescopic stanchion 101. The span of the telescopic stanchion 101 is adjustable.

The pedestal 102 is a structure that forms the final link of the load path between the invention 100 and the supporting surface 192. The pedestal 102 is a disk-shaped structure. The pedestal 102 is formed with a sufficient mass such that the position of the pedestal 102 will not shift while the invention 100 is in use.

The telescopic stanchion 101 is a vertically oriented post. The telescopic stanchion 101 raises the elevation of each of the plurality of hangers 103 such that the one or more hairpieces 191 may be suspended above the supporting surface 192 from the plurality of hangers 103. The vertical span of the telescopic stanchion 101 is adjustable.

The telescopic stanchion 101 further comprises a first arm 111, a second arm 112 and a first detent 121. The first detent 121 connects the second arm 112 to the first arm 111. The first arm 111 comprises a first prism 141 and a first plurality of slots 151. The first arm 111 is further defined with a first end 181 and a second end 182. The first arm 111 is further defined with an inner dimension. The second arm 112 comprises a second prism 142 and a second plurality of slots 152. The second arm 112 is further defined with a third end 183 and a fourth end 184. The second arm 112 is further defined with an outer dimension and an inner dimension. The first arm 111 and the second arm 112 are geometrically similar. The outer dimension of the second arm 112 is less than the inner dimension of the first arm 111 such that the second arm 112 can be inserted into the first arm 111 in a telescopic manner.

This telescopic arrangement of the telescopic stanchion 101 allows the length of the telescopic stanchion 101 to be adjusted by adjusting the relative position of the second arm 112 within the first arm 111. The position of the second arm 112 relative to the first arm 111 is held in position using the first detent 121. The first detent 121 is a mechanical device that connects and secures the first arm 111 to the second arm 112. The first detent 121 is selected from the group consisting of a cotter pin, a G snap collar, a cam lock collar, a threaded clutch, a split collar lock, or a spring loaded ball lock.

The telescopic stanchion 101 further comprises a third arm 113 and a second detent 122. The second detent 122 connects the third arm 113 to the second arm 112. The third arm 113 comprises a third prism 143, a third plurality of slots 153, and a superior wig mount 163. The third arm 113 is further defined with a fifth end 185 and a sixth end 186. The third arm 113 is further defined with an outer dimension. The second arm 112 and the third arm 113 are geometrically similar. The outer dimension of the third arm 113 is less than the inner dimension of the second arm 112 such that the third arm 113 can be inserted into the second arm 112 in a telescopic manner.

This telescopic arrangement of the telescopic stanchion 101 allows the length of the telescopic stanchion 101 to be adjusted by adjusting the relative position of the third arm 113 within the second arm 112. The position of the third arm 113 relative to the second arm 112 is held in position using the second detent 122. The second detent 122 is a mechanical device that connects and secures the second arm 112 to the third arm 113. The second detent 122 is selected from the group consisting of a cotter pin, a G snap collar, a cam lock collar, a threaded clutch, a split collar lock, or a spring loaded ball lock.

The first plurality of slots 151 is a collection of apertures formed through the lateral face of the first prism 141. Each of the first plurality of slots 151 are identical. The fastener 133 attaches to a slot selected from the first plurality of slots 151. The inner dimensions of each of the first plurality of slots 151 are sized such that the clip 171 of the fastener 133 of any individual hanger 130 selected from the plurality of hangers 103 inserts into any slot selected from the first plurality of slots 151.

The second plurality of slots 152 is a collection of apertures formed through the lateral face of the second prism 142. Each of the second plurality of slots 152 are identical. The fastener 133 attaches to a slot selected from the second plurality of slots 152. The inner dimensions of each of the second plurality of slots 152 are sized such that the clip 171 of the fastener 133 of any individual hanger 130 selected from the plurality of hangers 103 inserts into any slot selected from the second plurality of slots 152.

The third plurality of slots 153 is a collection of apertures formed through the lateral face of the third prism 143. Each of the third plurality of slots 153 are identical. The fastener 133 attaches to a slot selected from the third plurality of slots 153. The inner dimensions of each of the third plurality of slots 153 are sized such that the clip 171 of the fastener 133 of any individual hanger 130 selected from the plurality of hangers 103 inserts into any slot selected from the third plurality of slots 153.

The superior wig mount 163 is discussed in greater detail elsewhere in this disclosure.

Each of the plurality of hangers 103 is a structure that projects radially away from the center axis of the telescopic stanchion 101. Each of the plurality of hangers 103 projects away from the telescopic stanchion 101 in the manner of a cantilever. Each of the plurality of hangers 103 suspends a hairpiece selected from the one or more hairpieces 191 above the supporting surface 192. The selected hairpiece hangs from the free end 188 of a hanger selected from the plurality of hangers 103. The plurality of hangers 103 comprises a collection of individual hangers 130. Each individual hanger 130 comprises a wig mount 131, an extension structure 132, and a fastener 133. The extension structure 132 is further defined with a fixed end 187 and a free end 188. The individual hanger 130 refers to any hanger selected from the plurality of hangers 103. Any selected individual hanger 130 is identical to each individual hanger 130 remaining in the plurality of hangers 103.

The wig mount 131 is a disk-shaped structure that attaches to the free end 188 of the extension structure 132. The disk shape of the wig mount 131 distributes the weight of the one or more hairpieces 191 over a larger surface area than the use of a hook would provide. The increase of surface area allows the wig mount 131 to minimize the stress applied to the hairpiece selected from the one or more hairpieces 191 while the selected hairpiece hangs from the individual hanger 130. The wig mount 131 forms the superior surface of the individual hanger 130.

The extension structure 132 is a plate structure that creates a span of distance between the wig mount 131 and the telescopic stanchion 101.

The fastener 133 is a structure that attaches the fixed end 187 of the extension structure 132 to the telescopic stanchion 101. The fastener 133 comprises a clip 171 and a shoulder 172. The clip 171 is a hook that inserts into a slot selected from a plurality of slots selected from the group consisting of the first plurality of slots 151, the second plurality of slots 152, and the third plurality of slots 153. The clip 171 attaches the individual hanger 130 to the telescopic stanchion 101. The shoulder 172 is a notch formed in the fixed end 187 of the extension structure 132. The shoulder 172 is formed such that the extension structure 132 of the individual hanger 130 will sit flush against the telescopic stanchion 101.

The superior wig mount 163 is identical to the wig mount 131 of any individual hanger 130 selected from the plurality of hangers 103. The superior wig mount 163 attaches to the superior end of the telescopic stanchion 101 such that a hairpiece selected from the one or more hairpieces 191 can be suspended from the telescopic stanchion 101. The superior wig mount 163 is the superior structure of the invention 100.

The following two paragraphs describe the assembly of the invention 100.

The first end 181 of the first arm 111 attaches to the superior end of the pedestal 102 such that the first arm 111 projects perpendicularly away from the pedestal 102 in the superior direction. The third end 183 of the second arm 112 inserts into the second end 182 of the first arm 111 where it is secured in position by the first detent 121. The fifth end 185 of the third arm 113 inserts into the fourth end 184 of the second arm 112 where it is secured in position by the second detent 122. The superior wig mount 163 attaches to the sixth end 186 of the third arm 113 such that the end of the superior wig mount 163 is parallel to the supporting surface 192.

The fastener 133 of any individual hanger 130 selected from the plurality of hangers 103 inserts into a slot selected from the plurality of slots selected from the group consisting of the first plurality of slots 151, the second plurality of slots 152, and the third plurality of slots 153.

The following definitions were used in this disclosure:

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Cylinder: As used in this disclosure, a cylinder is a geometric structure defined by two identical flat and parallel ends, also commonly referred to as bases, which are circular in shape and connected with a single curved surface, referred to in this disclosure as the face. The cross-section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder which is defined as a cylinder wherein the curved surface perpendicularly intersects with the two identical flat and parallel ends.

Detent: As used in this disclosure, a detent is a device for positioning and holding a first object relative to a second object such that the position of the first object relative to the second object is adjustable.

Disk: As used in this disclosure, a disk is a cylindrically shaped object that is flat in appearance.

Extension Structure: As used in this disclosure, an extension structure is an inert physical structure that is used to extend the span of the distance between any two objects.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Hairpiece: As used in this disclosure, a hairpiece is a device that is used to augment the natural hair of a person for fashion or cosmetic purposes. A hairpiece may contain either natural hair or artificial hair to make this augmentation. Toupee, wig, and hair extension are synonyms for a hairpiece.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity.

Inner Dimension: As used in this disclosure, the term inner dimension describes the span from a first inside or interior surface of a container to a second inside or interior surface of a container. The term is used in much the same way that a plumber would refer to the inner diameter of a pipe.

Load Path: As used in this disclosure, a load path refers to a chain of one or more structures that transfers a load generated by a raised structure or object to a foundation, supporting surface, or the earth.

Notch: As used in this disclosure, a notch is: 1) an indentation formed in an edge; or 2) a cavity or aperture formed within a surface.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Pedestal: As used in this disclosure, a pedestal is an intermediary load bearing structure that that transfers a load path between a supporting surface and an object, structure, or load.

Plate: As used in this disclosure, a plate is a smooth, flat and rigid object that has at least one dimension that: 1) is of uniform thickness; and 2) that appears thin relative to the other dimensions of the object. Plates often have a rectangular or disk-like appearance.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Radial: As used in this disclosure, the term radial refers to a direction that: 1) is perpendicular to an identified central axis; or, 2) projects away from a center point.

Stanchion: As used in this disclosure, a stanchion refers to a vertical pole, post, or support.

Superior: As used in this disclosure, the term superior refers to a directional reference that is parallel to and in the opposite direction of the force of gravity.

Supporting Surface: As used in this disclosure, a supporting surface is a horizontal surface upon which an object is placed. Within this disclosure, it is assumed that the object is placed on the supporting surface in an orientation that is appropriate for the normal or anticipated use of the object.

Suspend: As used in this disclosure, to suspend an object means to support an object such that the inferior end of the object does not form a significant portion of the load path of the object.

Telescopic: As used in this disclosure, telescopic is an adjective that describes an object made of sections that fit or slide into each other such that the object can be made longer or shorter by adjusting the relative positions of the sections.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A stand for performing hairdressing work comprising wherein the stand for performing hairdressing work comprises a telescopic stanchion, a pedestal, and a plurality of hangers;

wherein the telescopic stanchion attaches the pedestal to the plurality of hangers;

wherein the stand for performing hairdressing work is configured for use with a hairpiece selected from one or more hairpieces;

wherein the stand for performing hairdressing work is configured to sit on a tabletop or other supporting surface;

wherein the stand for performing hairdressing work is a stand upon which one or more hairpieces are stored;

wherein the stand for performing hairdressing work is adjustable such that the number of hairpieces stored on the stand for performing hairdressing work is adjustable;

wherein the telescopic stanchion is a vertically oriented post;

wherein the telescopic stanchion raises the elevation of each of the plurality of hangers above the supporting surface;

wherein each of the plurality of hangers removably attaches to the telescopic stanchion;

wherein a span of the telescopic stanchion is adjustable;

wherein each of the plurality of hangers is a structure that projects radially away from the center axis of the telescopic stanchion;

wherein each of the plurality of hangers projects away from the telescopic stanchion in a cantilevered manner;

wherein each of the plurality of hangers is adapted to suspend a hairpiece selected from the one or more hairpieces above the supporting surface;

wherein the plurality of hangers comprises a collection of individual hangers;

wherein any selected individual hanger is identical to each individual hanger remaining in the plurality of hangers;

wherein the telescopic stanchion further comprises a first arm, a second arm, and a first detent;

wherein the first detent connects the second arm to the first arm;

wherein the first arm is further defined with a first end and a second end;

wherein the first arm is further defined with an inner dimension;

wherein the second arm is further defined with a third end and a fourth end;

wherein the second arm is further defined with an outer dimension and an inner dimension;

wherein the first arm and the second arm are geometrically similar;

wherein the outer dimension of the second arm is less than the inner dimension of the first arm such that the second arm inserts into the first arm in a telescopic manner;

wherein the span of the length of the telescopic stanchion is adjusted by adjusting the relative position of the second arm within the first arm;

wherein the position of the second arm relative to the first arm is held in position using the first detent;

wherein the first arm comprises a first prism and a first plurality of slots;

wherein the second arm comprises a second prism and a second plurality of slots;

wherein the first plurality of slots is a collection of apertures formed through a lateral face of the first prism;

wherein the second plurality of slots is a collection of apertures formed through a lateral face of the second prism;

wherein the telescopic stanchion further comprises a third arm and a second detent;

wherein the second detent connects the third arm to the second arm;

wherein the third arm is further defined with a fifth end and a sixth end;

wherein the third arm is further defined with an outer dimension;

wherein the second arm and the third arm are geometrically similar;

wherein the outer dimension of the third arm is less than the inner dimension of the second arm such that the third arm inserts into the second arm in a telescopic manner;

wherein the span of the length of the telescopic stanchion is adjusted by adjusting the relative position of the third arm within the second arm;

wherein the position of the third arm relative to the second arm is held in position using the second detent;

wherein the third arm comprises a third prism, a third plurality of slots, and a superior wig mount;

wherein the third plurality of slots is a collection of apertures formed through a lateral face of the third prism;

wherein each of the third plurality of slots are identical;

wherein each individual hanger comprises a wig mount, an extension structure, and a fastener;

wherein the extension structure attaches the fastener to the wig mount;

wherein the extension structure is further defined with a fixed end and a free end;

wherein the wig mount is a disk-shaped structure that attaches to the free end of the extension structure;

wherein the extension structure is a plate structure;

wherein the extension structure creates a span of distance between the wig mount and the telescopic stanchion;

wherein the fastener attaches the fixed end of the extension structure to the telescopic stanchion;

wherein the fastener attaches to a slot selected from a plurality of slots selected from the group consisting of the first plurality of slots, the second plurality of slots, and the third plurality of slots;

wherein the fastener comprises a clip and a shoulder;

wherein the clip attaches the individual hanger to the telescopic stanchion;

wherein the shoulder is a notch formed in the fixed end of the extension structure.

2. The stand for performing hairdressing work according to claim 1 wherein the clip is a hook;

wherein the clip inserts into a slot selected from a plurality of slots selected from the group consisting of the first plurality of slots, the second plurality of slots, and the third plurality of slots;

wherein the inner dimensions of each of the first plurality of slots are sized such that the clip of the fastener of any individual hanger selected from the plurality of hangers inserts into any slot selected from the first plurality of slots;

wherein the inner dimensions of each of the second plurality of slots are sized such that the clip of the fastener of any individual hanger selected from the plurality of hangers inserts into any slot selected from the second plurality of slots;

wherein the inner dimensions of each of the third plurality of slots are sized such that the clip of the fastener of any individual hanger selected from the plurality of hangers inserts into any slot selected from the third plurality of slots.

3. The stand for performing hairdressing work according to claim 2 wherein the shoulder is formed such that the extension structure of the individual hanger sits flush against the telescopic stanchion.

4. The stand for performing hairdressing work according to claim 3 wherein the third arm further comprises the superior wig mount.

5. The stand for performing hairdressing work according to claim 4 wherein the first end of the first arm attaches to a superior end of the pedestal such that the first arm projects perpendicularly away from the pedestal in a superior direction;

wherein the third end of the second arm inserts into the second end of the first arm where it is secured in position by the first detent;

wherein the fifth end of the third arm inserts into the fourth end of the second arm where it is secured in position by the second detent;

wherein the superior wig mount attaches to the sixth end of the third arm such that the end of the superior wig mount is parallel to the supporting surface;

wherein the first detent is a mechanical device;

wherein the second detent is a mechanical device that connects and secures the second arm to the third arm;

wherein the first detent is selected from the group consisting of a cotter pin, a G snap collar, a cam lock collar, a threaded clutch, a split collar lock, or a spring loaded ball lock;

wherein the second detent is selected from the group consisting of a cotter pin, a G snap collar, a cam lock collar, a threaded clutch, a split collar lock, or a spring loaded ball lock.

* * * * *